US006783727B2

(12) United States Patent
Bannykh et al.

(10) Patent No.: US 6,783,727 B2
(45) Date of Patent: Aug. 31, 2004

(54) AUSTENITIC STEEL

(75) Inventors: Oleg Alexandrovich Bannykh, Moscow (RU); Viktor Mikhailovich Blinov, Moscow (RU); Maria Vladimirovna Kostina, Moscow (RU); Viktor Andreevich Malyshevsky, Sankt-Peterburg (RU); Tsolo Vylkovich Rashev, Sofia (BG); Grigory Jurievich Kalinin, Sankt-Peterburg (RU); Ljudmila Georgievna Rigina, Moscow (RU); Alexei Viktorovich Dymov, Moscow (RU); Jury Ivanovich Ustinovschikov, Izhevsk (RU)

(73) Assignee: Institut Metallurgii I Materialovedenia Imeni A.A. Baikova Rossiiskoi Akademii NAUK, Moscow (RU)

( * ) Notice: Subject to any disclaimer, the term of this patent is extended or adjusted under 35 U.S.C. 154(b) by 88 days.

(21) Appl. No.: 09/979,778

(22) PCT Filed: Apr. 24, 2001

(86) PCT No.: PCT/RU01/00172

§ 371 (c)(1),
(2), (4) Date: Feb. 6, 2002

(87) PCT Pub. No.: WO01/81644

PCT Pub. Date: Nov. 1, 2001

(65) Prior Publication Data

US 2003/0039574 A1 Feb. 27, 2003

(30) Foreign Application Priority Data

Apr. 25, 2000 (RU) ..... 2000110329

(51) Int. Cl.[7] ..... C22C 38/18
(52) U.S. Cl. ..... 420/65; 148/325
(58) Field of Search ..... 148/325; 420/65

(56) References Cited

U.S. PATENT DOCUMENTS

| | | | | | |
|---|---|---|---|---|---|
| 4,116,683 | A | * | 9/1978 | Nikolov et al. | 420/65 |
| 4,865,661 | A | * | 9/1989 | Dalmann et al. | 420/65 |
| 5,405,575 | A | | 4/1995 | Yazawa et al. | 420/42 |
| 5,714,115 | A | * | 2/1998 | Speidel et al. | 420/65 |

FOREIGN PATENT DOCUMENTS

| | | |
|---|---|---|
| EP | 0123054 | 10/1984 |
| RU | 2092606 | 10/1997 |
| SU | 1719456 | 3/1992 |

OTHER PUBLICATIONS

V.S. Kershenbaum (Ed.) "International Translator of Modern Steels & Alloys", *International Engineering Encyclopedia Series*, Moscow, 1992, p. 852–853.

* cited by examiner

*Primary Examiner*—Deborah Yee
(74) *Attorney, Agent, or Firm*—Ladas & Parry

(57) ABSTRACT

Austenitic steel contains from 0.01 to 0.04% by weight of carbon, from 21.00 to 24.00% by weight of chromium, from 0.25 to 5 0.65% by weight of silicon, from 0.25 to 0.70% by weight of manganese, from 1.00 to 1.40% by weight of nitrogen, the balance being iron, the total content of ferrite-forming components in the steel, namely, of silicon and chromium, and the total content of austenite-forming components therein, namely, of carbon, 10 nitrogen and manganese, obeying the following condition:

$$\frac{0.48[Si] + [Cr]}{30[C] + 18[N] + 0.01[Mn]} = \text{from } 0.8 \text{ to } 1.3,$$

where [Si], [Cr], [C], [N], [Mn] is the content in the steel of silicon, chromium, carbon, nitrogen, and manganese, respectively, expressed in % by weight.

9 Claims, No Drawings

AUSTENITIC STEEL

FIELD OF THE ART

The present invention relates to the field of metallurgy, and more particularly to corrosion-resistant and wear-resistant steel.

PRIOR ART

Various kinds of steel are known in the art, that are used in the manufacture of products related to medical engineering, e.g., prostheses, implants, medical tools, and the like. Steels used for the indicated purpose must meet definite requirements both from the standpoint of the interaction of products made from such steels with human organism and from the standpoint of the physico-mechanical characteristics thereof.

However, the strength and wear-resistance of the known steels used for medical purposes are not sufficient, and therefore prostheses, implants, and medical tools manufactured from the known steels cannot insure the required safety and reliability in the course of their operation and rapidly wear out. In the case of prolonged contact with human tissues the known steels used for medical purposes induce allergic reactions of human organism.

To the category of steels used for medical purposes there belong corrosion-resistant austenitic steels described in the International Translator of Modern Steels and Alloys (Prof. V. S. Kershenbaum (Ed.), "International Engineering Encyclopedia" Series, Moscow, 1992 (in Russian)), for instance, steel grade AISI 316H (USA), containing 0.04–0.10% by weight of carbon, 16.0–18.0% by weight of chromium, 10.0–14.0% by weight of nickel, 2.03.0% by weight of molybdenum, 1.0% by weight or less of silicon, 2.0% by weight or less of manganese, 0.03% by weight or less of sulfur, the balance being iron, or steel grade DIN 17440 (DE), containing not more than 0. 1% by weight of carbon, not more than 1.0% by weight of silicon, not more than 2.0% by weight of manganese, not more than 0.045% by weight of phosphorus, not more than 0.03% by weight of sulfur, 16.5-18.5% by weight of chromium, 12.0–14.0% by weight of nickel, less than 5.0% by weight of titanium and 2.0–3.0% by weight of molybdenum.

Said steels have a single-phase austenitic structure, but they contain an appreciable amount of critical and costly nickel which, among other things, may induce allergic reactions in human organism when said steels are used for medical purposes; furthermore, said steels contain manganese which reacts with human blood.

Besides, said steels have a low strength ($\sigma_B$ being less than 520 MPa, $\sigma_{0.2}$ being less than 250 MPa) and an insufficient wear-resistance, so that they fail to meet the requirements to the materials for products to be used in medical engineering.

Closest in its chemical composition to the steel of the present invention is the corrosion-resistant steel described in EP No. 0123054, 06.05.1987. This steel contains, in % by weight: carbon, from 0.01 to 0.5; chromium, from 3.0 to 45.0; niobium, up to 10.0; silicon, up to 2.0; manganese, up to 0.10; molybdenum, up to 10.0; vanadium, up to 5.0;

titanium, niobium and/or tantalum, up to 2.0; cerium, up to 1.0; aluminum, up to 0.3; nitrogen, from 0.2 to 5.0; iron, the balance.

Said steel has an austenitic-ferritic structure and is magnetizable. At 400° C. said steel has the yield point $R_{p\,0.2\,(\sigma 0.2)}$ less than 400 N/mm$^2$ and at 600° C. it has the yield point $R_{p\,0.2\,(\sigma 0.2)}$ less than 250 N/mm$^2$. The described steel is intended, owing to its heat resistance, for manufacturing gas and steam turbines.

The above-indicated steel is not suitable for manufacturing products to be used in medical engineering, because, in the first place, its structure comprises at least 50% of ferromagnetic components able to react with human blood containing iron ions; in the second place, said steel contains manganese and nickel which induce allergic reactions when in contact with human tissues.

DISCLOSURE OF THE INVENTION

The present invention is directed to the provision of a nonmagnetic steel which has a high mechanical strength, high corrosion and wear resistance, plasticity and is inactive with respect to human tissues.

Said object is accomplished in the provision of a steel containing carbon, chromium, silicon, manganese, nitrogen and iron, which steel, according to the invention, contains said 10 components in the following relationship, % by weight:

| | |
|---|---|
| carbon | from 0.01 to 0.04 |
| chromium | from 21.00 to 24.00 |
| silicon | from 0.25 to 0.65 |
| manganese | from 0.25 to 0.70 15 |
| nitrogen | from 1.00 to 1.40 |
| iron | the balance, |

the total content of ferrite-forming components in the steel, namely, of silicon and chromium, and the total content of aus-tenite-forming components therein, namely, of carbon, nitrogen 20 and manganese, obeying the following condition:

$$\frac{0.48[\mathrm{Si}] + [\mathrm{Cr}]}{30[\mathrm{C}] + 18[\mathrm{N}] + 0.01[\mathrm{Mn}]} = \text{from } 0.8 \text{ to } 1.3,$$

where [Si], [Cr], [C], [N], [Mn] is the content in the steel of silicon, chromium, carbon, nitrogen, and manganese, respectively, expressed in % by weight.

According to the invention, the proposed steel has a single-phase austenitic structure, the yield point 00.2 from 700 to 900 MPa, the breaking point $\sigma_B$ from 1100 to 1250 MPa, obtained after water quenching at a temperature of from 1190 to 1230° C. or obtained after water quenching at a temperature of from 1190 to 1230° C. and subsequent tempering at a temperature of from 400 to 430° C. for 3 to 3.5 hours with subsequent cooling in air.

Owing to the invention, the claimed nonmagnetic steel having a single-phase structure possesses a high mechanical strength, high corrosion- and wear-resistance, plasticity, and is inactive with respect to human tissues.

Th Further objects and advantages of the claimed invention will become clear from the following detailed description of the proposed austenitic steel and examples of its particular composition.

A nonmagnetic steel with the single-phase austenitic structure has been developed, that has a high mechanical strength, plasticity, corrosion- and wear-resistance, suitable for the manufacture of products to be used in medical engineering, for instance, prostheses, implants, medical tools, and the like.

THE BEST MODE FOR CARRYING OUT THE INVENTION

The steel claimed in the present invention contains from 0.01 to 0.04% by weight of carbon, from 21.00 to 24.00% by weight of chromium, from 0.25 to 0.65% by weight of silicon, from 0.25 to 0.70% by weight of manganese, from 1.00 to 1.40% by weight of nitrogen, the balance being iron, the total content of ferrite-forming components in the steel, namely, of silicon and chromium, and the total content of austenite-forming components therein, namely, of carbon, nitrogen and manganese, obeying the following condition:

$$\frac{0.48[\mathrm{Si}] + [\mathrm{Cr}]}{30[\mathrm{C}] + 18[\mathrm{N}] + 0.01[\mathrm{Mn}]} = \text{from } 0.8 \text{ to } 1.3,$$

where [Si], [Cr], [C], [N], [Mn] is the content in the steel of silicon, chromium, carbon, nitrogen, and manganese, respectively, expressed in % by weight.

The results of our investigations have shown that with the content of nitrogen in the steel less than 1.0% by weight, homogeneous y-solid solution (austenite) cannot be obtained in its structure, whereas with the content of nitrogen exceeding the claimed 1.4% by weight the conditions of melting and working the steel become complicated; the presence of nitrogen in the specified amount makes it possible to increase the yield point of the steel by as much as 2 to 3 times and to rule out introducing nickel and manganese, added heretofore to steel for these purposes, these additives inducing allergic reactions when in contact with human tissues. The content of chromium in the claimed amount of from 21.00 to 24.00% by weight increases the corrosion resistance of the steel, and under the indicated melting conditions the solubility of nitrogen can be increased eight-fold. It is difficult to attain the content of carbon in the steel less than the claimed 0.01% by weight without additional metallurgical operations, which make the steel appreciably more expensive; with the content of carbon exceeding the claimed 0.04% by weight the conditions, the conditions of formation of the homogeneous structure of nitrogen austenite are substantially complicated by the process of separation of large particles of chromium carbide of $Cr_{23}C_6$ type along the grain boundaries or of the formation of carbonitrides which lead to lowering the plasticity of steel and its resistance to intercrystallite corrosion. The content of chromium less than the claimed 21.00% by weight complicates the conditions of melting the steel with the claimed nitrogen content, which, as it was indicated, ranges from 1.00 to 1.40% by weight and insures the attainment, after tempering, of a homogeneous austenitic structure of steel containing no δ-ferrite or α-martensite ferromagnetic phases; with the content of chromium exceeding the claimed 24% by weight, the 6-phase and nitrides appear in the steel structure, which deteriorate the mechanical properties of steel and are soluble only at temperatures that are technically difficult to achieve.

Our investigations have shown that for obtaining stable austenitic structure of the claimed steel the ratio of the sum of ferrite-forming components, namely, of silicon and chromium, to austenite-forming components, namely, carbon, nitrogen and manganese, is also of importance. So, it was found that when $$\frac{0.48[\mathrm{Si}] + [\mathrm{Cr}]}{30[\mathrm{C}] + 18[\mathrm{N}] + 0.01[\mathrm{Mn}]} < 0.8,$$

a completely austenitic structure of steel cannot be obtained, while in the case of $$\frac{0.48[\mathrm{Si}] + [\mathrm{Cr}]}{30[\mathrm{C}] + 18[\mathrm{N}] + 0.01[\mathrm{Mn}]} > 1.3,$$

δ-ferrite appears in the steel structure.

Water quenching at a temperature of 1190–1230° C. is sufficient for the homogenization of the γ-solid solution—at a temperature above 1230° C. grain growth and the appearance of δ-ferrite are observed; at a temperature lower than 1190° C. complete dissolution of nitrides which deteriorate the viscosity and plasticity of steel cannot be attained. Tempering from the temperature of 430° C. for 3–3.5 hours does not lead to the decomposition and nitrogen depletion of austenite. At a temperature not exceeding 400° C. the strength of steel is not impaired. Keeping for 3–3.5 hours is sufficient for ensuring homogeneity of the steel structure.

The austenitic steel claimed in the present invention has high physico-mechanical characteristics: the yield point ($\sigma_{0.2}$) is 700–900 MPa, the breaking point ($\sigma_B$) is 1100–1250 MPa, a considerable abrasive resistance at an elevated plasticity: δ is 28–51%, ψ is 20.5–39.0%. Said characteristics provide an increased service life and reliability of constructions and products from such steel, including implants subject to high loads, for instance, coxofemoral endoprostheses.

The claimed steel is advantageous over the prior art in that the content of carbon which contributes to the formation of thrombi is minimized, nickel which may induce allergic reactions and eczema is absent, and the steel is non-magnetic (because ferromagnetic material actively reacts with blood containing iron ions).

Therefore, the claimed austenitic steel can be used as a highly strong, wear- and corrosion-resistant non-magnetic material in the manufacture of products related to medical engineering, e.g., prostheses, implants, medical tools, and the like, providing for shortening the postoperative period of patients, ruling out the origination of inflammatory processes.

The claimed steel will also find successful application in instrument-making, power plant engineering, diesel building, cryogenic technology.

For a better understanding of the present invention, examples of its particular embodiment are given hereinbelow.

EXAMPLE

The melting of austenitic steel was carried out in an induction furnace under 22 atm pressure of gaseous nitrogen (melts 1–4, where melt 1 corresponded to the steel described in EP 123054 and melts 2–4 corresponded to the steel claimed in the present invention). For determining the mechanical properties of the steel obtained in melts 1–4 and its resistance to intercrystallite corrosion after heat treatment, the following samples were forged at 1200° C.: 13×13 mm rods (melt 1, 2.1, 2.2, 3, 4); a large-size sample from which a 50×50 mm fragment was cut out (melt 2.3), on which the mechanical properties of the steel and its resistance to intercrystallite corrosion were determined.

The amount of austenite and martensite in the steel obtained in melts 14 was determined on an x-ray diffractometer. Mechanical elongation tests were carried out with elongation rate of 1 mm/min on cylindrical samples with the 5 mm diameter of the working surface. Resistance to intercrystallite corrosion was determined by the method of potentiodynamic reactivation in an electrolyte (mole/liter)—$0.5H_2SO_4$+0.01KSCN—with polarization from minus 0.5 to plus 0.3 V with the scanning rate of $2.5\times10^{-3}$ V/sec. The measure of alloy resistance to intercrystallite corrosion was assumed to be the ratio (K) of the reactivation charge to the passivation charge.

Comparative tests of the claimed steel (melts 3, 4) and of the known steel A128 MB2 (International Translator of Modern Steels and Alloys (Prof. V. S. Kershenbaum (Ed.), "International Engineering Encyclopedia" Series, Moscow, 1992 (in Russian)) for wear resistance using a secured abrasive were carried out on a laboratory setup. The samples performed back-and-forth motion with their end face part against a polishing paper on a corundum base after breaking-in under similar conditions. The length of one working stroke of the samples was 0.13 meter, the sample friction path per test with the rate of movement equal to 0.158 m/sec was 78 meters. The transverse displacement of the polishing paper per double stroke of the sample was 0.0012 meter. Normal load on the sample was 98 N (specific load was 100 MPa). The adopted test conditions insured insignificant heating of the working surface of the samples. Before and after testing the samples were weighed on an analytical balance with the scale division value of 0.1 mg. The relative wear-resistance in abrasive wear was determined as an arithmetic mean of the results of two parallel tests, using the formula:

$$\varepsilon = \frac{M_r}{M_i},$$

where $M_r$ is the absolute mass wear of the reference sample, g;

$M_t$ is the absolute mass wear of the test sample, g.

A sample of steel grade A128B2, widely used as a wear-resistant material for products and constructions subject to high loads, after tempering at 1100° C. with water quenching, was adopted as the reference sample.

Tables 1, 2 and 3 that follow show the chemical composition of the melted steel, % by weight (Table 1); the mechanical properties and resistance of steel whose chemical composition is shown in Table 1, to intercrystallite corrosion after heat treatment (Table 2); the results of testing for wear the steel whose composition is shown in Table 1 (Table 3).

TABLE 1

| Melt No. | C | N | Cr | Mn | Si | Ni | Mo | Q* |
|---|---|---|---|---|---|---|---|---|
| 1 | 0.0 | 0.51 | 13.0 | 1.05 | 0.50 | 2.90 | 3.50 | 1.32 |
| 2 | 0.02 | 1.02 | 21.45 | 0.19 | 0.42 | — | — | 1.13 |
| 3 | 0.02 | 1.281 | 21.44 | 0.22 | 0.40 | — | — | 0.96 |
| 4 | 0.03 | 1.29 | 23.85 | 0.22 | 0.45 | — | — | 0.99 |

$$Q^* = \frac{0.48\,[Si] + [Cr]}{30\,[C] + 18\,[N] + 0.01[Mn]}$$

TABLE 2

| Melt No. | Heat treatment | $\sigma_B$, MP | $\sigma_{0.2}$, MPa | δ, % | ψ, % | K* |
|---|---|---|---|---|---|---|
| 1 | Annealing 950° C. + tempering 650° C. | 820 | 600 | 22 | — | 0.11 |
| 2.1 | Hardening 1200° C. | 1250 | 860 | 28 | 24 | 0.10 |
| 2.2 | Annealing 1200° C. + tempering 400° C., 3 hours | 1250 | 900 | 29.5 | 22.5 | 0.10 |
| 2.3 | Annealing 1200° C. + tempering 400° C., 3 hours | 1100 | 700 | 23 | 25 | 0.10 |
| 3 | Annealing 1200° C. + tempering 400° C., 3 hours | 1250 | 895 | 29 | 20.5 | 0.10 |
| 4 | Annealing 1200° C. + tempering 400° C., 3 hours | 1250 | 815 | 51.0 | 39.0 | 0.09 |

at K* < 0.11 the alloy is not liable to intercrystallite corrosion

TABLE 3

| Melt No. | Heat treatment | Relative wear-resistance, ε |
|---|---|---|
| 3 | Annealing 1200° C. | 1.23 |
| 4 | Annealing 1200° C. + tempering 400° C., 3 hours | 1.06 |
| 4 | Annealing 1200° C. | 1.40 |
| 4 | Annealing 1200° C. + tempering 400° C., 3 hours | 1.32 |
| Steel | Annealing 1200° C. Annealing 1200° C. + tempering 400° C., 3 hours | 1 (reference sample) |
| A128MB2 | | 0.95 |

INDUSTRIAL APPLICABILITY

The claimed austenitic steel will find application in the manufacture of products related to medical engineering, e.g., prostheses, implants, medical tools, and the like, insuring shortening of the postoperative period of patients, ruling out the origination of inflammatory processes; the claimed steel will also find successful application in instrument-making, power plant engineering, diesel building, cryogenic technology.

What is claimed is:

1. Steel containing carbon, chromium, silicon, manganese, nitrogen and iron, wherein said steel contains said components in % by weight as follows:

| | |
|---|---|
| carbon | from 0.01 to 0.04 |
| chromium | from 21.00 to 24.00 |
| silicon | from 0.25 to 0.65 |
| manganese | from 0.19 to 0.70 |
| nitrogen | from 1.00 to 1.4 |
| iron | balance, |

the silicon, chromium, carbon, nitrogen and manganese, being present in the steel in respective amounts such that $$\frac{0.48[Si] + [Cr]}{30[C] + 18[N] + 0.01[Mn]} = \text{from } 0.8 \text{ to } 1.3,$$

wherein [Si], [Cr], [C], [N], [Mn] represent the content in the steel of silicon, chromium, carbon, nitrogen, and manganese, respectively, in % by weight.

2. Steel according to claim 1, wherein said steel has a single-phase austenitic structure, a yield point $\sigma_{0.2}$ from 700 to 900 MPa, and a breaking point $\sigma_B$ from 1100 to 1250 MPa.

3. Steel according to claim 1, wherein said steel has a single-phase structure obtained after water quenching at a temperature of from 1190 to 1230° C.

4. Steel according to claim 1, wherein said steel has a single-phase structure obtained after water quenching at a temperature of from 1190 to 2300° C. and subsequent tempering at a temperature of from 400 to 430° C. for 3 to 3.5 hours with subsequent cooling in air.

5. Steel according to claim 1, wherein the manganese is present in the steel in an amount of 0.19 to 0.22 wt %.

6. A steel consisting essentially of iron, ferrite-forming components and austenite-forming components, the ferrite-forming components comprising silicon and chromium, the austenite-forming components comprising carbon, nitrogen and manganese, the ferrite-forming components and austenite-forming components being present in the steel in respective amounts such that:

$$\frac{0.48[Si] + [Cr]}{30[C] + 18[N] + 0.01[Mn]} = \text{from } 0.8 \text{ to } 1.3,$$

wherein the ferrite-forming and austenite-forming components are present in the steel in respective amounts such that the steel has a single-phase austenitic structure, a yield point $\sigma_{0.2}$ from 700 to 900 MPa, and a breaking point $\sigma_B$ from 1100 to 1250 MPa, with the carbon being present in the steel in an amount of 0.01 to 0.04 wt %, the chromium being present in the steel in an amount of 21.00 to 24.00 wt %, the silicon being present in the steel in an amount of 0.25 to 0.65 wt %, the manganese being present in the steel in an amount of up to 0.70 wt %, and the nitrogen being present in the steel in an amount of 1.00 to 1.4 wt %.

7. The steel according to claim 6, wherein the manganese is present in the steel in an amount of 0.19 to 0.22 wt %.

8. Steel according to claim 6, wherein said steel has a single-phase structure obtained after water quenching at a temperature of from 1190 to 1230° C.

9. Steel according to claim 6, wherein said steel has a single-phase structure obtained after water quenching at a temperature of from 1190 to 1230° C. and subsequent tempering at a temperature of from 400 to 430° C. for 3 to 3.5 hours with subsequent cooling in air.

* * * * *